US011313655B1

(12) United States Patent
Han

(10) Patent No.: US 11,313,655 B1
(45) Date of Patent: Apr. 26, 2022

(54) SCREW OFF BASEPLATE

(71) Applicant: U.S. Government as Represented by the Secretary of the Army, Dover, NJ (US)

(72) Inventor: Seungeuk Han, Highland Park, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 610 days.

(21) Appl. No.: 16/380,210

(22) Filed: Apr. 10, 2019

Related U.S. Application Data

(60) Provisional application No. 62/666,903, filed on May 4, 2018.

(51) Int. Cl.
*F42B 10/02* (2006.01)
*F42B 14/02* (2006.01)
*F42B 14/06* (2006.01)

(52) U.S. Cl.
CPC ..... *F42B 10/02* (2013.01); *F42B 14/02* (2013.01); *F42B 14/064* (2013.01)

(58) Field of Classification Search
CPC ..... F42B 10/02; F42B 14/02; F42B 14/064
USPC ..... 102/522
See application file for complete search history.

(56) References Cited

U.S. PATENT DOCUMENTS 4,314,510 A * 2/1982 Jeter ..... F42B 14/064 102/521
6,135,387 A * 10/2000 Seidel ..... F42B 10/40 244/3.15
9,194,675 B1 * 11/2015 Manole ..... F42B 10/14
10,118,696 B1 * 11/2018 Hoffberg ..... B64C 39/001

FOREIGN PATENT DOCUMENTS

WO WO-2013140182 A1 * 9/2013 ..... F42B 7/10
WO WO-2020047367 A1 * 3/2020 ..... F42B 10/02

* cited by examiner

*Primary Examiner* — Samir Abdosh
(74) *Attorney, Agent, or Firm* — John P. DiScala

(57) ABSTRACT

A rear slip base plate for a round carrying a guidance and control unit payload, which round is launched from a rifled launch tube. To prevent the guidance and control unit payload from also being rapidly spun with the round, the slip base plate unit mechanically isolates the guidance and control unit payload from the round spin rate.

4 Claims, 4 Drawing Sheets

SCREW OFF BASEPLATE

CROSS REFERENCE TO RELATED APPLICATIONS

This application claims benefit under 35USC119 (e) from provisional application 62/666,903 filed May 4, 2018, entitled "Screw Off Baseplate" by the same inventors herein and commonly assigned, the entire file wrapper contents of which are hereby incorporated by reference as though fully set forth.

U.S. GOVERNMENT INTEREST

The inventions described herein may be made, used, or licensed by or for the U.S. Government for U.S. Government purposes.

BACKGROUND OF INVENTION

Many currently deployed ammunition projectiles are equipped with their own on board guidance and control system (GCS) to further precision steer the projectile in flight, even after launch. Because of the onboard GCS systems such ammunition projectile must ideally not be spun on its longitudinal axis upon launch, or only negligibly so. This is because such rapid spinning later interferes with the operation of the GCS which would continue to rapidly spin during flight. Accordingly, such projectiles ideally might be no-spin fin stabilized, and launched out of smooth bore only launching tubes, at zero or very low spin rates. But normally they are fired out of a rifled gun which will have a very high spin rate depending on muzzle velocity and gun rifling. In this condition, the projectile is often equipped with a slip obturator ring to minimize the initial spin rate. Various plastic slip obturator rings are typically used. But the slip obturator ring has issues of structural integrity with poor performance inconsistencies. Additionally, the conventional obturator ring is not specifically designed to secure the clearance between the launching system and the muzzle brake, (also of obturation and petal separation), muzzle brake interference, fragmentation at the firing site, excessive unacceptable firing signatures and/or excessive bypassing gas. These incidents occur partly because the ring may break in the gun tube. Furthermore, the slip obturator ring's plastic material may not have a long term storage life. As mentioned however, currently rifled launching tubes are the norm. Because of the above problems, a compromise system is sought where a GCS nose system might still be launched on a projectile from a rifled tube, yet where the GCS components might still not spin appreciably.

BRIEF SUMMARY OF INVENTION

The invention is specifically applicable to a sabot type launching system, fired out of a rifled gun tube. The invention has a plastic rotating band 1 mounted on a plate 3, a GCS carrier 2, a composite stem screw rod 61 (cylinder and non-cylinder/square cross sectional rod) design to engage the sabot and the seat for a projectile. The screw rod will release the sabot when screwed back; and it will also free the sabot petals (not fully shown). Rotating band 1 has a conventional function. Plate 3 faces the gun pressure and also holds the rotating band, so it spins as it travels along the gun. Composite stem 61 is a sectioned part combining cylindrical screw portion and a non-cylindrical portion that locks with the plate 3 as well as carrier 2, yet still allows sliding along in lateral directions to free the petals. Composite stem 61 theoretically only needs enough teeth for the gun rifling. As an example, a 155 mm 58 caliber gun which has 20 calibers per turn only needs three teeth on the screw if it is designed to release the petal at position right after where the muzzle brake might be. Component 5 is either a friction pad or a bearing pad to control the spin differentials as may be desired between the carrier 2 and plate 3. In this invention, a screw-off baseplate is designed to separate the carrier from the sabot assembly by using a screw-off function. Advantages of this method include ability to use a conventional rotating band (of plastic or of metals such as copper) to take advantage of their historically proven performance and reliabilities. Other advantages include using the fixed spin ratio constrained by the gun rifle. A further advantage is in ability to provide a lock that can contain the sabot package but ensure its separation at a given time (not fully shown). Another advantage is having two mutually almost independent elements carrier 2 and plate 3 to control the spin transmitting between them and disengaging after a certain number of cycles of spin. The invention adds the following features to the baseplate: sabot lock minimizing spin and the torque stresses on the sabot section during launching, where carrier 2 and plate 3 can be separated at a specific spin cycle. This separation feature can be utilized in a sabot lock system to prevent potential muzzle brake interference. Other benefits of this invention would include more consistent gun pressure, control of bypassing gas, muzzle velocity and the firing signature, controlling the spin rate of the sabot system and ability to separate the two elements, an ability that may be useable for additional sabot securing features. In addition to those advantages, the invention adds benefit of minimized torque on the sabot system.

OBJECTS OF THE INVENTION

Accordingly, it is an object of the present invention to provide a slip baseplate means for use while launching a carrier, to decouple spin rate of carrier from the baseplate.

Another object of the present invention is to provide a round having means of launching a carrier containing a guidance and control system whereby the spin cycle of the carrier can be greatly reduced from the spin of the launching round.

It is yet a further object of the present invention to provide a slip baseplate for a rear obturator in a round having a payload wherein the baseplate completely decouples during flight through unscrewing of the baseplate from the payload.

It is a still further object of the present invention to provide a slip baseplate for a launch round which separates the petals of a round canister in flight by disconnecting a member in the baseplate through unsrewing the baseplate wherein the disconnected member will then release the petals.

These and other objects, features and advantages of the invention will become more apparent in view of the within detailed descriptions of the invention, the claims, and in light of the following drawings and/or tables wherein reference numerals may be reused where appropriate to indicate a correspondence between the referenced items. It should be understood that the sizes and shapes of the different components in the figures may not be in exact proportion and are shown here just for visual clarity and for purposes of explanation. It is also to be understood that the specific embodiments of the present invention that have been described herein are merely illustrative of certain applications of the principles of the present invention. It should further be understood that the geometry, compositions, values, and dimensions of the components described herein can be modified within the scope of the invention and are not generally intended to be exclusive. Numerous other modifications can be made when implementing the invention for a particular environment, without departing from the spirit and scope of the invention.

LIST OF DRAWINGS

DETAILED DESCRIPTION

Figure 1:
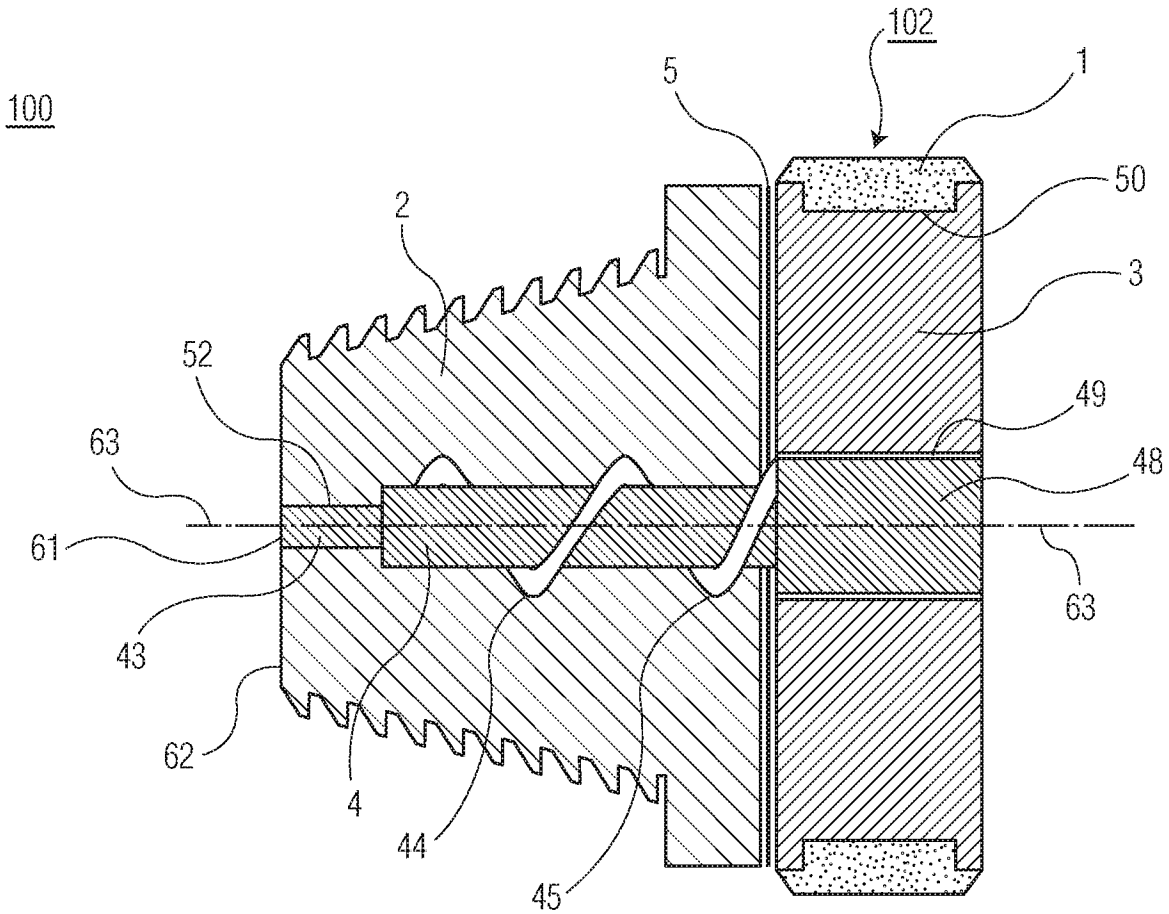
FIG. 1 shows a cross sectional view of a slip baseplate system with a carrier 2 payload, in accordance with this invention.
Figure 2:
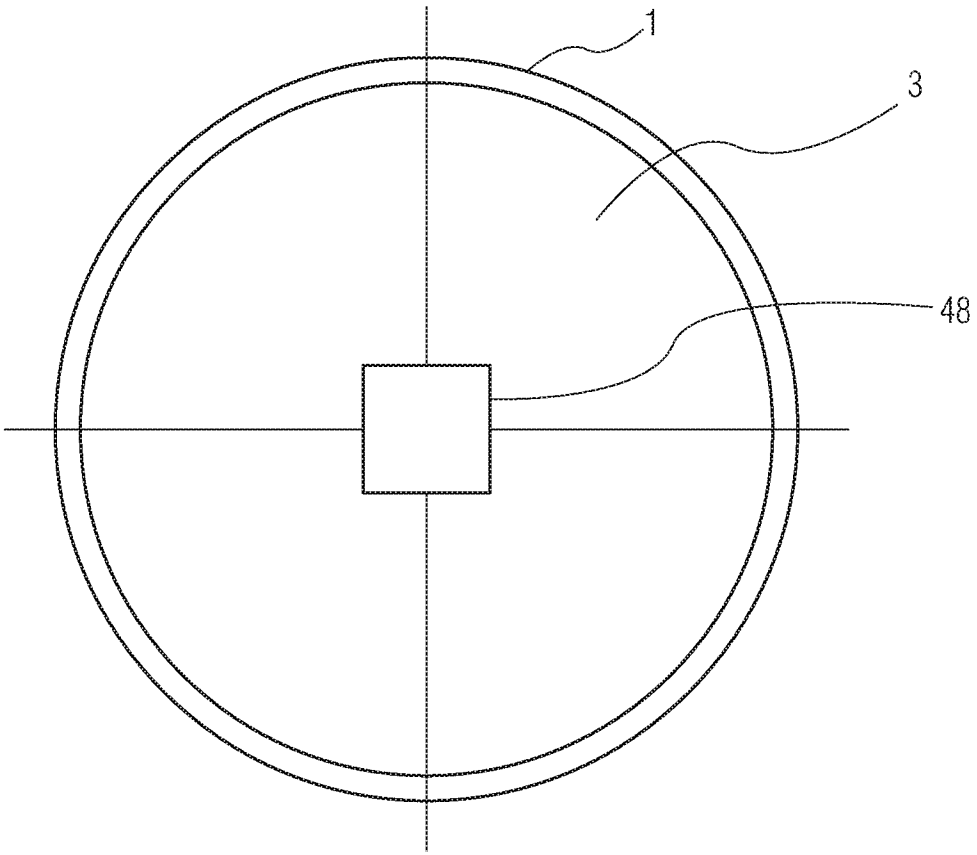
FIG. 2 illustrates a rear end view of the slip baseplate system of FIG. 1, in accordance with this invention.
Figure 3:
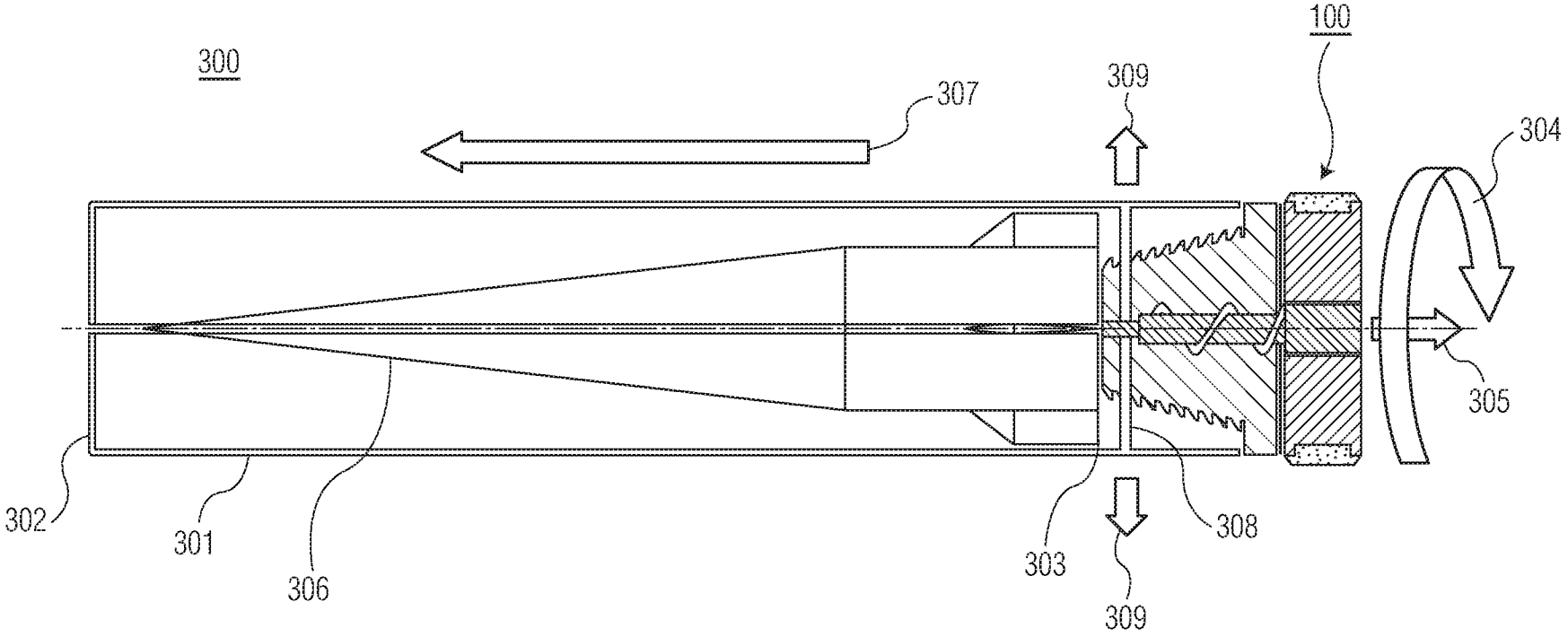
FIG. 3 shows a cross sectional view of launching round 300, implementing a slip baseplate system during a launching cycle, in accordance with this invention.
Figure 4:
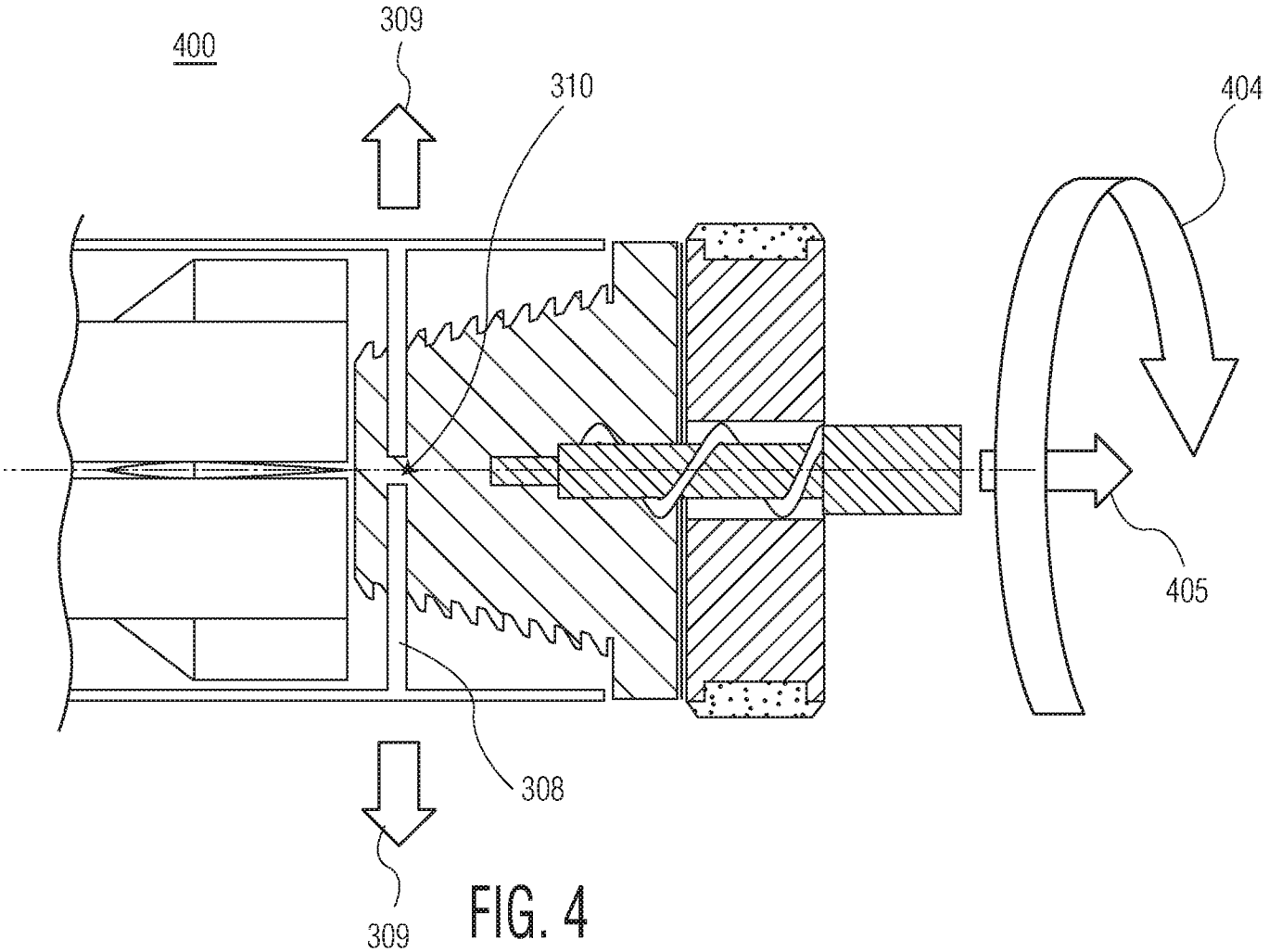
FIG. 4 illustrates scenario 400 which shows the effect of an unscrewed slip baseplate cross sectionally during the firing of round 300 of FIG. 3, in accordance with this invention.

FIGS. 1-4 show a rear slip base plate for a round carrying a guidance and control unit payload, which round is launched from a rifled launch tube. To prevent the guidance and control unit payload from also being rapidly spun with the round, the slip base plate unit mechanically isolates the guidance and control unit payload from the round spin rate. FIG. 3 shows a cross section of a round 300 for launching a guidance and control system (GCS) which GCS is degraded by rotational motion. The round has a main longitudinal axis 63; the guidance and control system is located within a forward saboted carrier housing 2 which has outer facing vanes 51 thereon. The saboted carrier housing 2 is located together with a rear screw off baseplate unit 102, together as an assembly 100 in the round. The carrier housing has screwed therein a one piece composite stem 61. Composite stem comprises stem first part 43 which is sized to fit into cavity 52, and a stem second part 4, and a stem third part 48 being a rearward facing square cross sectioned element. The square element mates into a circular disc shaped plate 3 that is attached rearwardly behind the carrier housing by means of a square cross sectional passage 49 which is sized to mate to stem third part 48. The carrier 2 further has thread grooves 44 therein and the stem second part 4 has threads 45 thereon which are sized to engage the thread grooves 44 in carrier 2 to be able to unscrew said composite stem. The composite stem backs away from the carrier in direction 305 when the composite stem 61 is turned clockwise in direction 304 looking from the rear. Plate 3 has a rotating band element 1 thereon, attached in a groove 50. The plate is free to rotate independently of carrier 2 if turned clockwise looking from the rear. There further is an annular shaped ball bearing friction pad 5 located between carrier 2 and plate 3. In pre-launch position the composite stem 61 is fully screwed in place so that stem first part 43 rests completely flush against the front at line 62, in cavity 52. During launch, plate 3 is rotated clockwise looking from the rear, through rotating band element 1 being engaged in rifle grooving found in its launching tube (not completely shown), and thereupon plate 3, rotating band 1 and the composite stem 61 are all unscrewed and separated from carrier 2 into direction 305. After such separation, carrier 2 is free to experience reduced rotational spin than does plate 3 during forward direction 307 launching of assembly 100 within said round. This is as a result of unscrewing action causing reduced rotational spin of said carrier 2. There may be three screw threads on threads 44, and thread grooves 45, for one carrier embodiment, for instance. The round 300 has a nose 306, an enclosing case 301 with a front 302 thereon, and a rear location 303 to where assembly 100 is connected, and wherein the round is launched forwardly in direction 307 and spins clockwise 304 as a result of rotating band element 1 engaging rifling in its launching tube. The round of claim 3 further has a multi-piece member 308 (not completely shown) having a hole 310 sized to engage stem first part 43 during pre-launch position. As a result of launch, an unscrewing of the composite stem 61 releases multi-piece member 308; this in turn releases petals in directions 309 of casing 301 freeing the carrier 2 with/without nose 306 into its flight. The multi-piece member 308 is not completely shown here, but it has separate parts that may pull out laterally from the carrier 2 after composite stem 61 unscrews from hole 310, and therefore no longer keeps the multi-piece member 308 in place. The multi-piece member would thereafter not be able to retain the petals in place since the petals are attached at distal ends of such multi-piece member.

While the invention may have been described with reference to certain embodiments, numerous changes, alterations and modifications to the described embodiments are possible without departing from the spirit and scope of the invention as defined in the appended claims, and equivalents thereof.

What is claimed is:

1. A round (300) for launching a guidance and control system which is degraded by rotational motion, said round having a main longitudinal axis (63), said guidance and control system being located within a forward saboted carrier housing (2) which has outer facing vanes (51) thereon and wherein said round is launched through a rifled launching tube, said forward saboted carrier housing (2) being located together with a rear screw off baseplate unit (102), together as an assembly (100) in said round, and wherein said forward saboted carrier housing has attached thereon a one piece composite stem (61) having stem first part (43) which is sized to fit into a cavity (52), and a stem second part (4), and a stem third part (48) being a rearward facing square cross sectioned element which mates into a circular disk shaped plate (3) that is attached rearwardly behind said forward saboted carrier housing by means of a square cross sectional passage (49) which is sized to mate to stem third part (48), and wherein the forward saboted carrier further has thread grooves (44) therein and the stem second part (4) has threads (45) thereon which are sized to engage the thread grooves (44) to unscrew said composite stem (61) backing it away (305) from said forward saboted carrier when said composite stem (61) is turned clockwise (304) looking from the rear, and wherein said circular disk shaped plate (3) has thereon a rotating band element (1) attached in a groove (50) of the circular disk shaped plate (3) and wherein circular disk shaped plate (3) is free to rotate independently of the forward saboted carrier (2) if turned clockwise looking from the rear, and there further is an annular shaped ball bearing friction pad (5) located between the forward saboted carrier (2) and circular disk shaped plate (3), and wherein composite stem (61) in pre-launch position is fully screwed in place so that stem first part (43) rests completely flush against a front line (62) in the cavity (52), whereupon, during launch circular disk shaped plate (3) is rotated clockwise looking from the rear, through the rotating band element (1) being engaged in rifle grooving of the launching tube, and thereupon circular disk shaped plate (3), the rotating band (1) and the composite stem (61) are all unscrewed and separated from the forward saboted carrier (2) into a direction (305), whereupon the forward saboted carrier (2) experiences reduced rotational spin than does circular disk shaped plate (3) during forward (307) launching of the assembly (100) within said round as a result of unscrewing action causing reduced rotational spin of said forward saboted carrier (2).

2. The round of claim 1 wherein there are three screw threads on threads (44), and thread grooves (45).

3. The round of claim 1 wherein said round (300) has a nose (306), an enclosing case (301) with a front (302) thereon, and a rear location (303) to where the assembly (100) is connected, and wherein the round is launched forwardly in direction (307) and spins clockwise (304) as a result of rotating band element (1) engaging rifling in the launching tube.

4. The round of claim 3 further having a member (308) having a hole (310) sized to engage the stem first part (43) in launch position whereupon, as a result of launch, unscrewing of the composite stem (61) releases a multi-piece member (308) which in turn releases petals in lateral directions (309) of enclosing case (301) freeing the forward saboted carrier (2) either with or without the nose (306) into its flight.

* * * * *